US010968915B2

(12) United States Patent
Giors et al.

(10) Patent No.: US 10,968,915 B2
(45) Date of Patent: Apr. 6, 2021

(54) HIGH-VACUUM PUMP

(75) Inventors: Silvio Giors, Fiano (IT); Gianluca Buccheri, Syracuse (IT); Mauro Nebiolo, Almese (IT)

(73) Assignee: Agilent Technologies, Inc., Santa Clara, CA (US)

( * ) Notice: Subject to any disclaimer, the term of this patent is extended or adjusted under 35 U.S.C. 154(b) by 895 days.

(21) Appl. No.: 13/576,498

(22) PCT Filed: Feb. 1, 2011

(86) PCT No.: PCT/IB2011/050434

§ 371 (c)(1),
(2), (4) Date: Oct. 22, 2012

(87) PCT Pub. No.: WO2011/092674

PCT Pub. Date: Aug. 4, 2011

(65) Prior Publication Data

US 2013/0045094 A1 Feb. 21, 2013

(30) Foreign Application Priority Data

Feb. 1, 2010 (IT) ..... TO2010A0070

(51) Int. Cl.
*F04D 19/04* (2006.01)
*F04D 29/02* (2006.01)
(Continued)

(52) U.S. Cl.
CPC ..... *F04D 19/042* (2013.01); *F04D 17/168* (2013.01); *F04D 27/0246* (2013.01);
(Continued)

(58) Field of Classification Search
CPC ..... F04D 19/02; F04D 19/04; F04D 19/044
See application file for complete search history.

(56) References Cited

U.S. PATENT DOCUMENTS 4,770,929 A * 9/1988 Nobumasa ..... B32B 5/28 428/367
4,990,207 A * 2/1991 Sakai ..... B29B 15/08 156/242
(Continued)

FOREIGN PATENT DOCUMENTS

DE 102008063131 A1 7/2010
EP 0545719 A1 3/1992
(Continued)

OTHER PUBLICATIONS

Victrex, High Performance Peek Polymers, Jun. 2009, pp. 1-2.*
(Continued)

*Primary Examiner* — Justin D Seabe
*Assistant Examiner* — Michael L Sehn

(57) ABSTRACT

A high-vacuum pump comprises a plurality of pumping stages, each comprising a plurality of mutually cooperating elements, including at least one rotating rotor element and one stationary stator element. At least one of the elements of at least one of the pumping stages is made of a plastic material reinforced with short fibres, dispersed in chaotic and substantially random manner inside the matrix of plastic material. Use of a plastic material reinforced with short fibres allows making the at least one element by injection molding and allows manufacturing the vacuum pump with considerably reduced production costs if compared to the conventional vacuum pumps.

13 Claims, 7 Drawing Sheets

(51) Int. Cl.
*F04D 27/02* (2006.01)
*F04D 17/16* (2006.01)

(52) U.S. Cl.
CPC ..... *F04D 29/023* (2013.01); *F05D 2300/43* (2013.01); *F05D 2300/603* (2013.01); *F05D 2300/605* (2013.01)

(56) References Cited

U.S. PATENT DOCUMENTS

| | | | | |
|---|---|---|---|---|
| 5,160,250 | A | 11/1992 | Ikegami et al. | |
| 5,202,293 | A * | 4/1993 | Okamoto | C04B 35/83 501/95.2 |
| 5,273,819 | A * | 12/1993 | Jex | B29C 70/14 264/172.11 |
| 5,525,558 | A * | 6/1996 | Niwa | C04B 35/83 156/242 |
| 6,399,695 | B1 * | 6/2002 | Moriwaki | C08L 67/02 524/504 |
| 6,648,619 | B2 * | 11/2003 | Otto | F01C 21/08 403/335 |
| 6,887,032 | B2 | 5/2005 | Favre-Felix et al. | |
| 2004/0076510 | A1 | 4/2004 | Favre-Felix et al. | |
| 2008/0260518 | A1 * | 10/2008 | Blumenthal | F04D 19/044 415/90 |
| 2009/0035123 | A1 * | 2/2009 | Stones | F04D 19/044 415/72 |
| 2010/0158667 | A1 * | 6/2010 | Helmer | F04D 17/168 415/97 |

FOREIGN PATENT DOCUMENTS

| | | | | |
|---|---|---|---|---|
| EP | 0545719 | A1 | 6/1993 | |
| EP | 0779434 | A1 | 11/1996 | |
| EP | 0779434 | A1 | 6/1997 | |
| GB | 2420379 | A | 11/2004 | |
| GB | 2420379 | A | 5/2006 | |
| JP | 62203721 | | 9/1987 | |
| JP | 10509747 | | 9/1998 | |
| JP | 2001517757 | | 10/2001 | |
| JP | 2006046074 | | 2/2006 | |
| JP | 2006348233 | | 12/2006 | |
| JP | 4148099 | | 9/2008 | |
| WO | W09505230 | | 2/1995 | |
| WO | 2005052375 | A1 | 6/2005 | |
| WO | WO2005052375 | A1 | 6/2005 | |
| WO | WO 2005052375 | A1 * | 6/2005 | F04D 19/042 |

OTHER PUBLICATIONS

Victrex; Company, Products, Applications; 2008; Slides 1-43.*
Machine Translation of WO2005052375.*
Office Action dated Jan. 6, 2015 in Japanese Application No. 2012-551718 (Unofficial/Non-certified translation provided by foreign agent included).
Machine Translation of JP2001517757.
Machine Translation of JP2006046074.
Machine Translation of JP2006348233.
Machine Translation of JP4148099.
Machine Translation of WO9505230.
Machine Translation of JP62203721.
International Search Report for International Application No. PCT/1132011/050434 filed on Feb. 1, 2011.
Office Action dated May 14, 2015 in Chinese Application No. 201180008064.0 (Unofficial/Non-certified translation provided by foreign agent included).
Office Action dated Sep. 29, 2014 in Chinese Application No. 201180008064.0.

* cited by examiner

HIGH-VACUUM PUMP

CROSS-REFERENCE TO RELATED APPLICATIONS

The present application is a national stage application under 35 U.S.C. § 371 of International Patent Application WO 2011/092674 filed on Feb. 1, 2011. The present application claims priority under 35 U.S.C. § 119 and 35 U.S.C. § 365 from International Patent Application WO 2011/092674; the present application also claims priority under from 35 U.S.C. § 119 from Italian Patent Application TO2010A000070 filed on Feb. 1, 2010. The entire disclosures of the referenced International Patent Application and the referenced Italian Patent Application are specifically incorporated herein by reference.

TECHNICAL FIELD

The present teachings relate to a vacuum pump, and more particularly, a high-vacuum pump comprising one or more elements made of plastic material, and intended to obtain high vacuum degrees.

BACKGROUND

Many different kinds of vacuum pumps are known in the art and are used according to the vacuum degree to be obtained.

For example, turbomolecular pumps are widely used for obtaining very high vacuum degrees, up to $10^{-8}$ Pa.

These turbomolecular pumps generally comprise a vacuum-tight casing that has an inlet or suction port, an outlet or discharge port, and a plurality of pumping stages arranged between the suction and discharge ports.

Each pumping stage includes a stator stage, comprising a stationary ring-shaped stator element, and a rotor stage, comprising a rotating disc-shaped rotor element, mounted integral with a rotating shaft and optionally equipped with peripheral vanes.

When the rotating shaft and the rotor elements mounted integral therewith are made to rotate at high speed (typically exceeding 10,000 rpm and even up to 100,000 rpm), gas pumping from the suction port to the discharge port is obtained based on cooperation of the rotor elements with the stator elements.

Turbomolecular pumps are often associated, at the high pressure side, with a molecular drag vacuum pump.

A molecular drag vacuum pump generally comprises a vacuum-tight casing comprising an inlet or suction port, an outlet or discharge port and a plurality of pumping stages arranged between the suction and discharge ports.

The pumping stages produce pumping action by momentum transfer from a fast-moving surface (moving at speed comparable to thermal speed of the molecules) directly to gas molecules. Generally, the pumping stages comprise a rotor element and a stator element cooperating with each other and defining a pumping channel therebetween: collisions of gas molecules in the pumping channel with the rotor element rotating at a very high speed cause gas in the channel to be pumped, from the inlet to the outlet of the channel itself.

Generally, according to the prior art, the rotor elements and the stator elements in high-vacuum pumps, and especially in turbomolecular and molecular drag vacuum pumps, are made of aluminium alloys. The limited specific weight and good mechanical strength of certain aluminium alloys enable high rotation speeds to be attained.

Recently, fibre-reinforced plastics (FRP), have been considered and evaluated for making rotor elements and other parts.

Generally, such solutions aim to attain a structural strength that is considerably higher than that of aluminum and its alloys and reduced weights, which enable higher peripheral speeds to be attained for the rotor elements, which in turn, increases the pumping speed of the vacuum pump. This is especially important for large pumps, where the maximum rotation speed of the rotor elements may be limited by the structural strength of the material.

The solutions concern the manufacture of disc-shaped rotor elements for turbomolecular pumps by using thermosetting resins reinforced with long fibres, such as carbon fibres, glass fibres, aramidic fibres and the like.

In order to increase the structural strength of the rotor element, such solutions use long reinforcing fibres all oriented in the maximum stress direction, for instance, the circumferential direction.

Such known solutions, appear very encouraging at theoretical level, but are difficult to put into practice, due to very high production costs. First, the need to obtain high structural strengths limits the degrees of freedom in the choice of the materials to be used. Second, the need to arrange the reinforcing fibres along one or more predetermined directions considerably increases the complexity of the production process and the costs related thereto.

In view of the above, there is a need for a high-vacuum pump, that uses plastic materials and that has lower production costs and reduced weight.

DETAILED DESCRIPTION

According to embodiments of the present teachings, use of plastic material in place of aluminium or other similar metals is aimed at reducing the production costs.

Thanks to the use of thermoplastic or thermosetting resins, possibly reinforced with short fibres, it is possible to make elements for the vacuum pump according to the embodiments of the present teachings by injection moulding, thus obtaining a production cost that is limited and competitive with respect to the conventional rotor elements made of aluminium.

Indeed, the short fibres used as reinforcement are randomly oriented in the matrix of the plastic material which eliminates the need to arrange the fibres along a preferential direction and allows employing the injection moulding technique in the production process. Even if using short fibres instead of long fibres gives a lower structural rigidity, experimental tests have shown that elements made from resins reinforced with short fibres have a structural strength slightly lower than, but anyway of the same order of magnitude as that of similar elements made of aluminium alloys.

Moreover, if the specific mechanical strength, that is the ratio between tensile breaking stress and specific weight, is considered, elements made from resins reinforced with short fibres have performance quite similar to that of similar elements made of aluminium alloys.

According to one embodiment, the vacuum pump includes at least one rotor element made of plastic material reinforced with short fibres.

According to another embodiment, the vacuum pump includes at least one stator element made of plastic material reinforced with short fibres.

According to another embodiment, the vacuum pump includes at least one turbomolecular rotor or stator element made of plastic material reinforced with short fibres.

According to another embodiment, the vacuum pump includes at least one molecular drag rotor or stator element made of plastic material reinforced with short fibres.

Typically, the plastic material used for the elements of the vacuum pump includes a thermoplastic resin, and such as a semi-crystalline polymer.

Preferably, the short fibres used for the elements of the vacuum pump include carbon or graphite short fibres, glass short fibres or aramidic short fibres.

The embodiments of the present teachings are especially suitable for manufacturing small-size or medium-size vacuum pumps (up to pumping speeds of the order of 700 l/s) and may provide for considerable reduction in the production costs when compared to the conventional solutions.

BRIEF DESCRIPTION OF THE DRAWINGS

Further features and advantages of the teachings will become apparent from the following detailed description of embodiments of the teachings, given by way of non-limiting example with reference to the accompanying drawings, in which.

DESCRIPTION OF THE EMBODIMENTS

Figure 1:
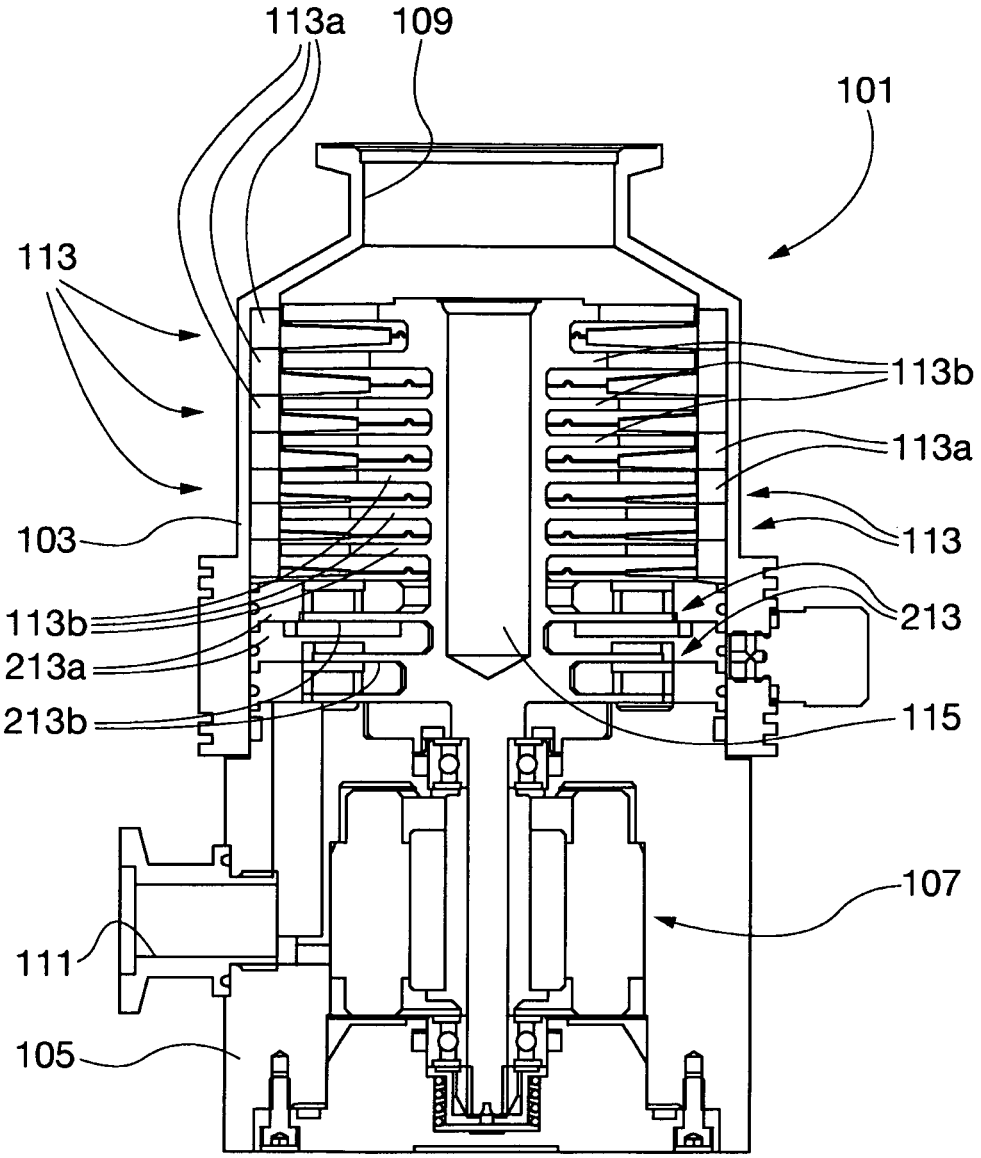
FIG. 1 is a schematic cross-sectional view of a turbomolecular vacuum pump.

Referring to FIG. 1, a high-vacuum pump 101 is schematically shown.

The high-vacuum pump 101 includes a vacuum-tight casing 103 mounted on a base 105, in which an electric motor 107 is housed. A suction port 109 and a discharge port 111 are defined in casing 103. Inside casing 103, a plurality of turbomolecular pumping stages ("pumping stages") 113, 213 are provided between the suction port 109 and the discharge port 111. More particularly, from the suction port 109 to the discharge port 111 a first plurality of turbomolecular pumping stages 113 and a second plurality of pumping stages 213 can be identified, the pumping stages 213 being provided downstream from the turbomolecular pumping stages 113.

In detail, each turbomolecular pumping stage 113 comprises at least; one stationary ring-shaped stator element 113*a*, fastened to casing 103; one disc-shaped rotor element 113*b*, mounted integral with a central rotating shaft 115 made to rotate at high speed, (higher than 10,000 rpm and up to 100,000 rpm) by electric motor 107; wherein the ring-shaped stator element 113*a* and the one disc-shaped rotor element 113*b* mutually cooperate for exerting a pumping effect on gas passing through turbomolecular pumping stage 113.

In detail, each pumping stage 213 comprises at least: one stationary stator element 213*a*, fastened to casing 103; one rotor element 213*b*, mounted integral with a central rotating shaft 115 made to rotate at high speed (higher than 10,000 rpm and up to 100,000 rpm) by electric motor 107; wherein the stator element 213*a* and the rotor element 213*b* mutually cooperate for exerting a pumping effect on gas passing through turbomolecular pumping stage 113.

According to embodiments of the present teachings, the vacuum pump comprises a plurality of pumping stages arranged between a suction port and a discharge port. Each the pumping stage comprises a plurality of elements mutually cooperating for pumping gas passing through the pumping stage, the elements comprising at least one stationary stator element and at least one rotating rotor element cooperating with each other, wherein at least one of the elements of at least one of the pumping stages is made of a plastic material charged with reinforcing short fibres.

Preferably, the plastic material is a thermoplastic resin or a thermosetting resin.

More preferably, the plastic material is a semi-crystalline polymer, and further more preferably, an aromatic semi-crystalline polymer.

Preferably, the reinforcing short fibres are randomly oriented in the matrix of plastic material.

Preferably, the reinforcing short fibres are carbon or graphite short fibres, glass short fibres or aramidic short fibres.

Preferably, the short fibre charge in the plastic material is in the range 10% to 50% in weight of the material, and more preferably in the range 30% to 40% in weight of the material.

Note that, in this context: the term "thermoplastic resin" denotes a polymer passing from the solid state to the viscous state when the temperature increases, and back from the viscous state to the solid state when the temperature decreases, so that it can be repeatedly worked and moulded; term "thermosetting resin" denotes a polymer the rigidity of which increases in irreversible manner when the temperature increases, so that it cannot be molten again without undergoing a degradation; the term "semi-crystalline polymer" denotes a polymer of which the chains, by folding, are capable of regularly arranging longer or shorter sections thereof side by side, thereby forming regular crystalline regions; the term "aromatic semi-crystalline polymer" denotes a semi-crystalline polymer comprising aromatic groups; the term "short fibres" denotes fibres the size of which is negligible with respect to the size of the matrix of plastic material into which the fibres are introduced; in particular, the short fibres generally have a size shorter than 10 mm and, preferably, shorter than 1 mm.

Since the short fibres have a negligible size with respect to the element made of plastic material, they are not oriented in a preferential direction, but are dispersed in a chaotic and substantially random manner inside the matrix of plastic material.

Advantageously, the elements of the vacuum pump made in accordance with the present teachings can be produced starting from a mixture of plastic material in a viscous state, charged with short fibres, by means of the injection moulding process.

The possibility of using such a process allows considerably limiting the production costs of the elements if compared to similar elements made of aluminium alloys, which conventionally are obtained, by mechanical machining or electrical discharge machining.

Such a process, on the contrary could not be used for manufacturing similar elements made of plastic materials reinforced with long fibres, which have to be arranged all along a preferential direction; in this case complex operations for correctly arranging the fibres are necessary and, in case of thermosetting materials, expensive processes to be performed in an autoclave are also required.

Figure 2:
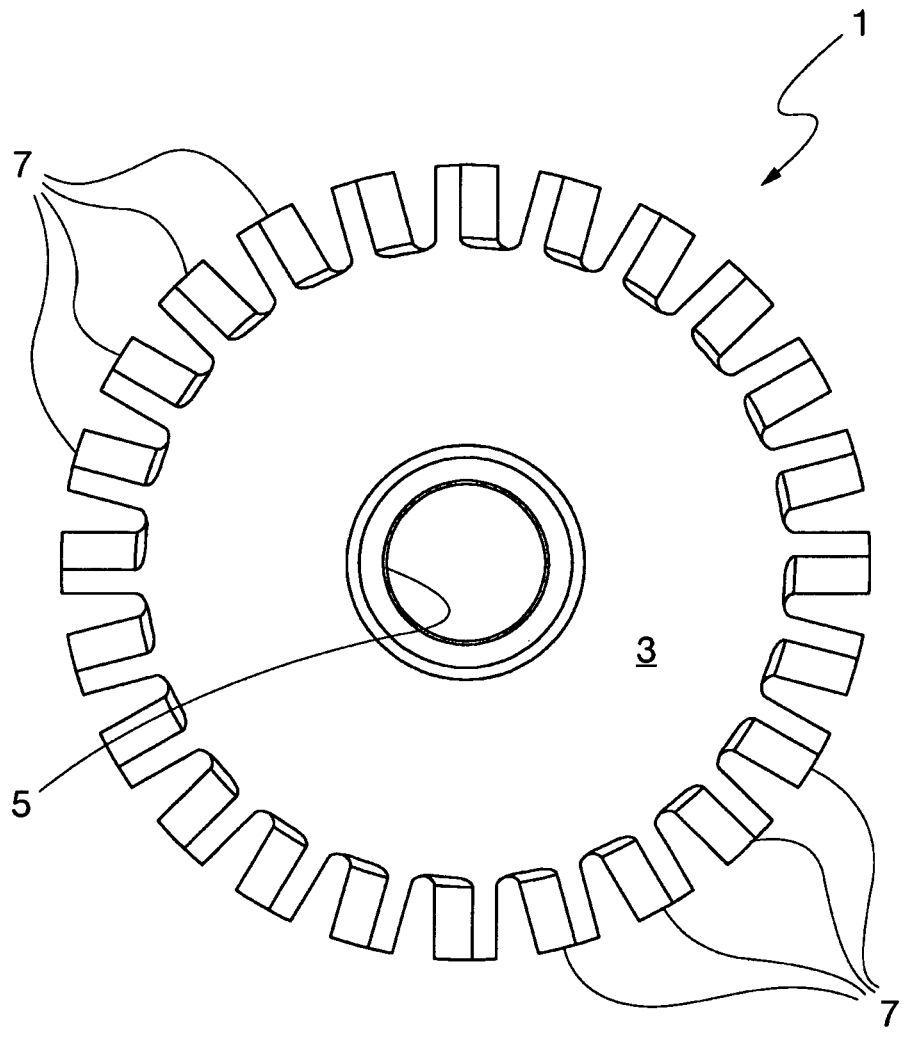
FIG. 2 is a plan view of a turbomolecular rotor element of a pump according to a first embodiment.
Figure 3:
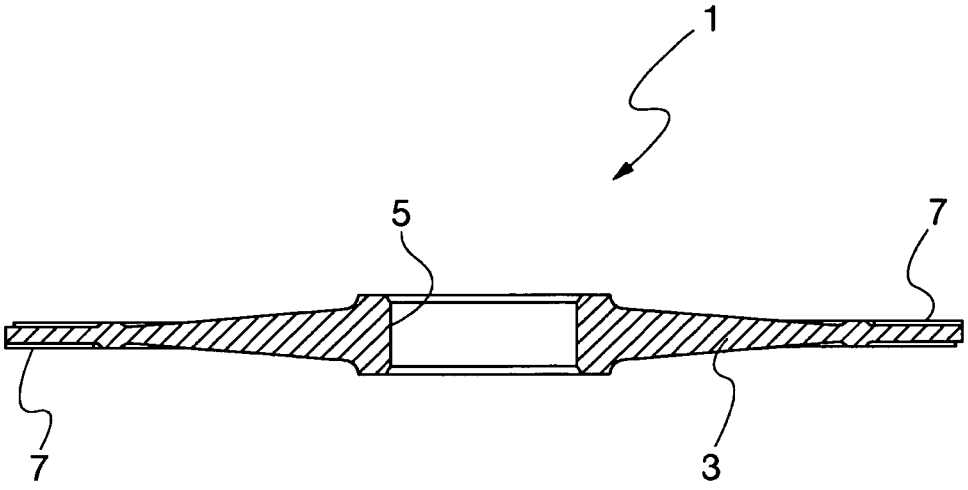
FIG. 3 is a schematic cross-sectional view of the rotor element shown in FIG. 2.

FIGS. 2 and 3 relate to a first embodiment, in which at least a rotor element 1 of at least one turbomolecular pumping stage of the vacuum pump is made of plastic material charged with short fibres.

It is to be appreciated, that such an embodiment is not at all limiting, and that it is possible to provide a vacuum pump in which, for instance, at least the stator element of at least one turbomolecular pumping stage of the vacuum pump is made of plastic material charged with short fibres, without thereby departing from the scope of the present invention.

Referring to FIGS. 2 and 3, turbomolecular rotor element 1 is substantially disc-shaped and comprises a substantially flat circular body 3 and is provided with a central through-hole 5 through which the rotating shaft of the vacuum pump passes and with peripheral radial vanes 7.

It will be clear for the skilled in the art that rotor element 1 could even be smooth, without vanes, or could, have vanes with a different geometry.

Preferably, as shown in FIG. 3, body 3 of rotor element 1 is slightly tapered from the centre to the periphery. In this manner, the thickness of rotor element 1 is greater at the centre, where stresses are stronger, and smaller at the periphery, where stresses are weaker.

In this respect, it is to be appreciated that experimental tests have shown that the stresses a turbomolecular rotor element undergoes are mainly circumferential stresses in the more central portion of the disc and substantially radial stresses in the portion where the vanes are present.

The chaotic and substantially random distribution of the short, fibres advantageously allows providing a good resistance to both the stresses at the disc center and the stresses at the disc periphery, even if the stresses are differently oriented: this should not be possible if long fibres, arranged along a single preferential direction, were used. It would, typically involve complex and expensive systems for joining parts having fibres that are differently oriented, in order to cope with the differently oriented stresses.

Turbomolecular rotor element 1 is entirely made of plastic material charged with short fibres.

In particular, VICTREX® PEEK (polyether ether ketone) material marketed by company Victrex plc, Thornton Cleveleys, Lancashire, UK or TORLON® material marketed by company Solvay Advanced Materials L.L.C., Alpharetta, Ga., USA, suitably charged with carbon short fibres in an amount of 30%-40%, exhibited performance that is particularly encouraging for making rotor elements such as rotor element 1 and is also compatible with the high-vacuum environment in which such materials are to operate.

In this respect, hereinafter a table is included in which some of the main characteristics of PEEK charged with 30% of carbon short fibres are compared with those of aluminum.

In particular, in the table below there are reported: the specific weight (PS); the tensile breaking stress (S); the specific mechanical strength (RMS=S/PS); the thermal emissivity (EMT).

| | PS ($N/mm^{3)}$ | S (MPa) [MPa] | RMS/$10^7$ (mm) [mm] | EMT |
|---|---|---|---|---|
| Aluminium | 0.000027 | 50 | 1.6 | 0.27 |
| PEEK | 0.000014 | 40 | 1.7 | 0.84 |

By analysing the above table, the skilled in the art will immediately deduce that: using PEEK allows obtaining much lighter elements than when using aluminium; the tensile breaking stress of PEEK is lower than that of aluminium, but anyway of the same order of magnitude; the ratio of the structural strength to the specific weight of PEEK is substantially the same as that of aluminium; the polar moment of inertia of a rotor made of PEEK is lower than that of aluminium, what which allows reducing the ramp time in the transient phase; the thermal emissivity of PEEK is considerably higher than that of aluminium, what which sensibly increases thermal efficiency, taking into account that heat exchanges inside a vacuum pump mainly take place by radiation.

By exploiting the injection moulding process, the production cost of a rotor element of PEEK is considerably lower than that of a rotor element of aluminium formed by mechanical machining or electrical discharge machining.

Moreover, use of a plastic material such as PEEK allows sensibly increasing the corrosion resistance with respect to an element made of aluminium.

Figure 4:
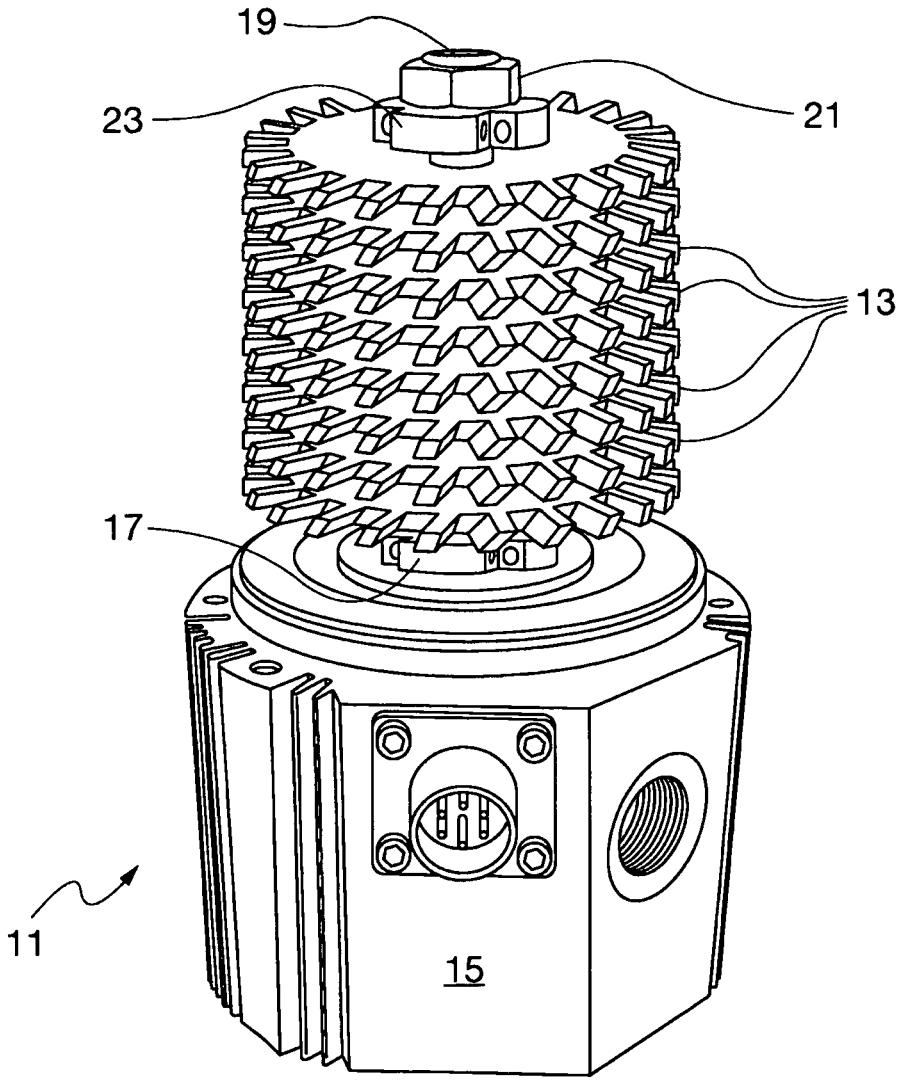
FIG. 4 is a front view of a pump according to the first embodiment, shown with the casing and the stator removed.

Turning now to FIG. 4, there is partly shown a turbomolecular vacuum pump 11 according to a first embodiment, where rotor elements 13 of all turbomolecular pumping stages are of the kind shown in FIGS. 2 and 3, that is they are made of plastic material reinforced with short fibres.

In FIG. 4, turbomolecular vacuum pump 11 is shown without the vacuum-tight casing and the stator elements fastened thereto.

Rotor elements 13 are mounted on base 15 of the turbomolecular vacuum pump 11 with the interposition of a bottom plate 17 containing the dowels for balancing the rotor.

The rotor elements 13 are fitted onto rotating shaft 19 of turbomolecular vacuum pump 11, which passes through the central through-holes formed in the elements and are stacked on one another to form the vacuum pump rotor.

The stack of rotor elements 13 is then axially compressed by screwing a nut 21 on the top end of shaft 19, which is threaded for that purpose.

A top plate 23 containing the dowels for balancing the rotor is interposed between the uppermost rotor element 13 and nut 21.

In a small pump like that shown in FIG. 4, comprising eight pumping stages, making the eight rotor elements 13 of plastic material reinforced with short fibres, e.g. PEEK reinforced with 30% of carbon short fibres, by injection moulding, allows reducing the production costs by about 75% with respect to making a conventional rotor of aluminium alloy.

In an alternative embodiment with respect to what is shown in FIG. 4, the rotor of a turbomolecular vacuum pump comprising a plurality of rotor elements 13 can be manufactured as a single, monolithic piece, for instance by injection moulding.

In this respect, it is to be noted that a rotor made of plastic materials reinforced with long fibres could not be manufactured as a monolithic piece by injection moulding, since the long fibres have to be arranged all along a preferential direction.

On the contrary, as in the rotor elements according to representative embodiments described below in which the short fibres are arranged in a chaotic and substantially random way, the manufacturing of a rotor comprising a plurality of rotor elements as a single, monolithic piece is allowed, thus permitting to manufacture a rotor in a very inexpensive process.

Figure 5:
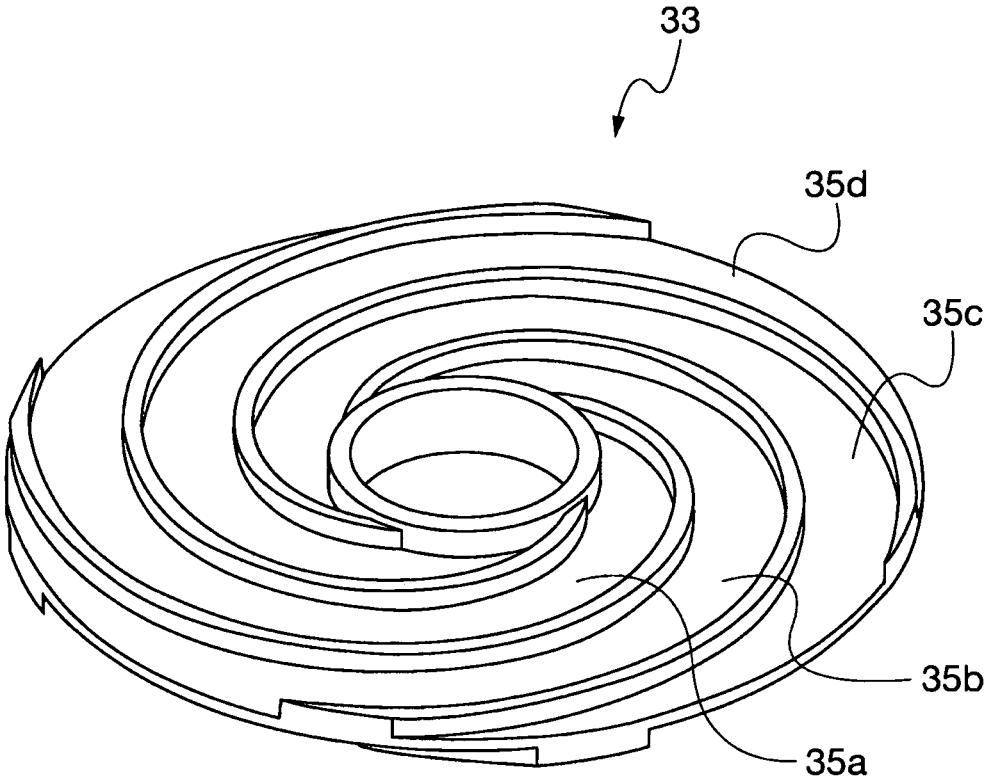
FIG. 5 is a perspective view of a molecular drag rotor element of a pump according to a second embodiment.

With reference now to FIG. 5, a second embodiment is shown, in which at least a rotor element 33 of at least one molecular drag pumping stage of the vacuum pump is made of plastic material charged with short fibres.

It is to be appreciated that such an embodiment is not at all limiting, and that it is possible to provide a vacuum pump in which, for instance, at least the stator element of at least one molecular pumping stage of the vacuum pump is made of plastic material charged, with short fibres.

Referring to FIG. 5, according to the illustrated embodiment, rotor element 33 is substantially disc-shaped and comprises a rotor body having at least one spiral channel 35*a*, 35*b*, 35*c*, 35*d* on a first surface, which in use is arranged opposite the smooth surface of a corresponding stator element and cooperate therewith for pumping the gas through the molecular pumping stage.

Preferably, the rotor element 33 comprises a rotor body having at least one spiral channel on a first surface and at least one further spiral channel on its opposite surface, each of the rotor surfaces cooperating with the smooth surface of a respective stator element for obtaining two different pumping stages, wherein in the spiral channels of the first surface of the rotor element 33 the gas flows in a first direction (i.e., centripetal or centrifugal) while in the spiral channels of the second surface of the rotor element 33 the gas flows in a second, direction opposite to the first direction (i.e., centrifugal or centripetal)

Advantageously, in the illustrated embodiment the cross-sectional area of the spiral channels is reduced from the center to the outer periphery of the rotor body irrespective of whether the gas flows through the channel in a centripetal or centrifugal direction. In such manner, the product of the channel cross-sectional area and the rotor velocity normal to the aforesaid area (i.e. the internal gas flow velocity) can be advantageously maintained constant.

It is to be appreciated, that such an embodiment is not at all limiting and that a different geometric configuration for the rotor spiral channels can alternatively be chosen.

Moreover, other different kinds of molecular pumping stages, such as for instance a conventional Siegbahn pumping stage.

Figure 6:
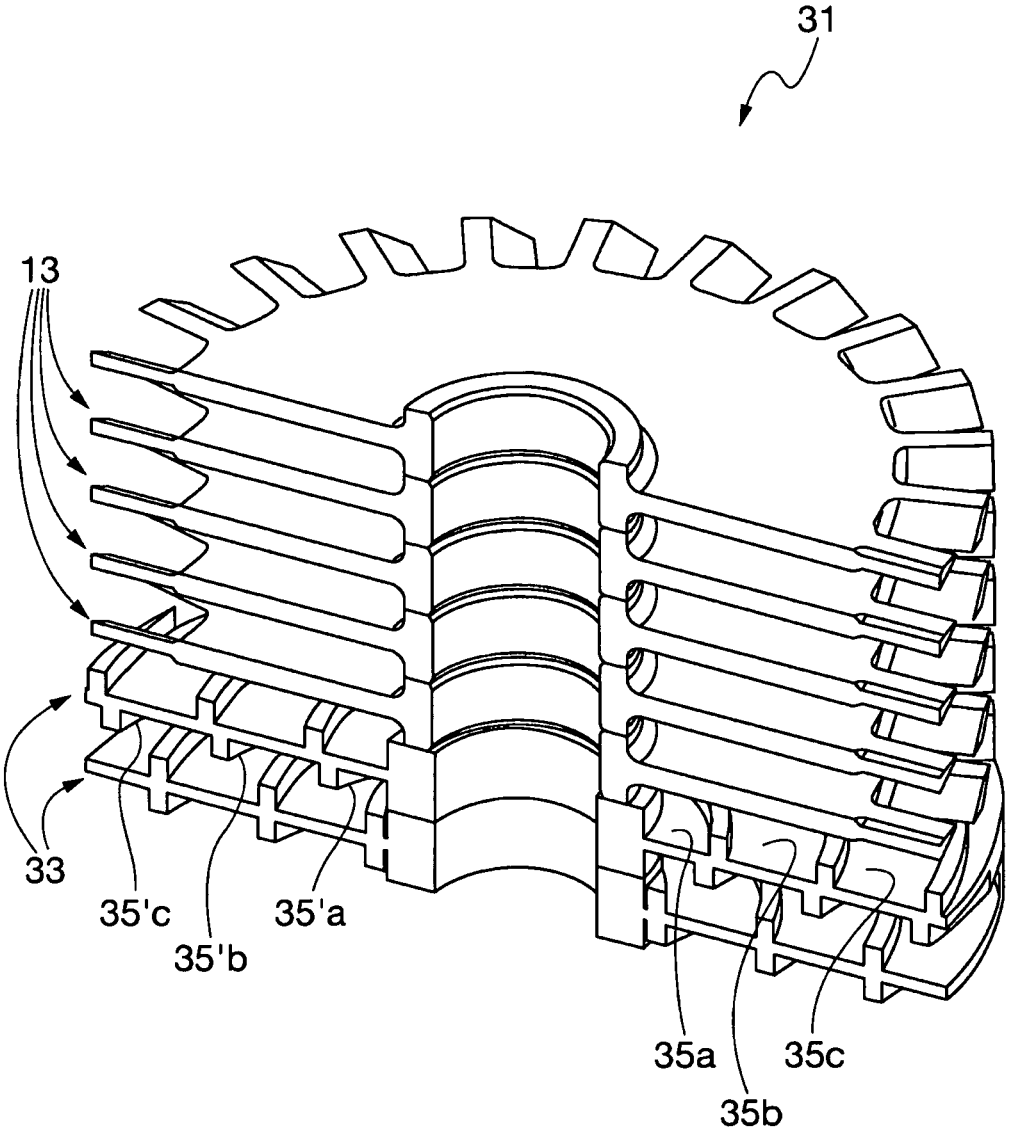
FIG. 6 is a perspective bottom view of a pump rotor according to the second embodiment.
Figure 7:
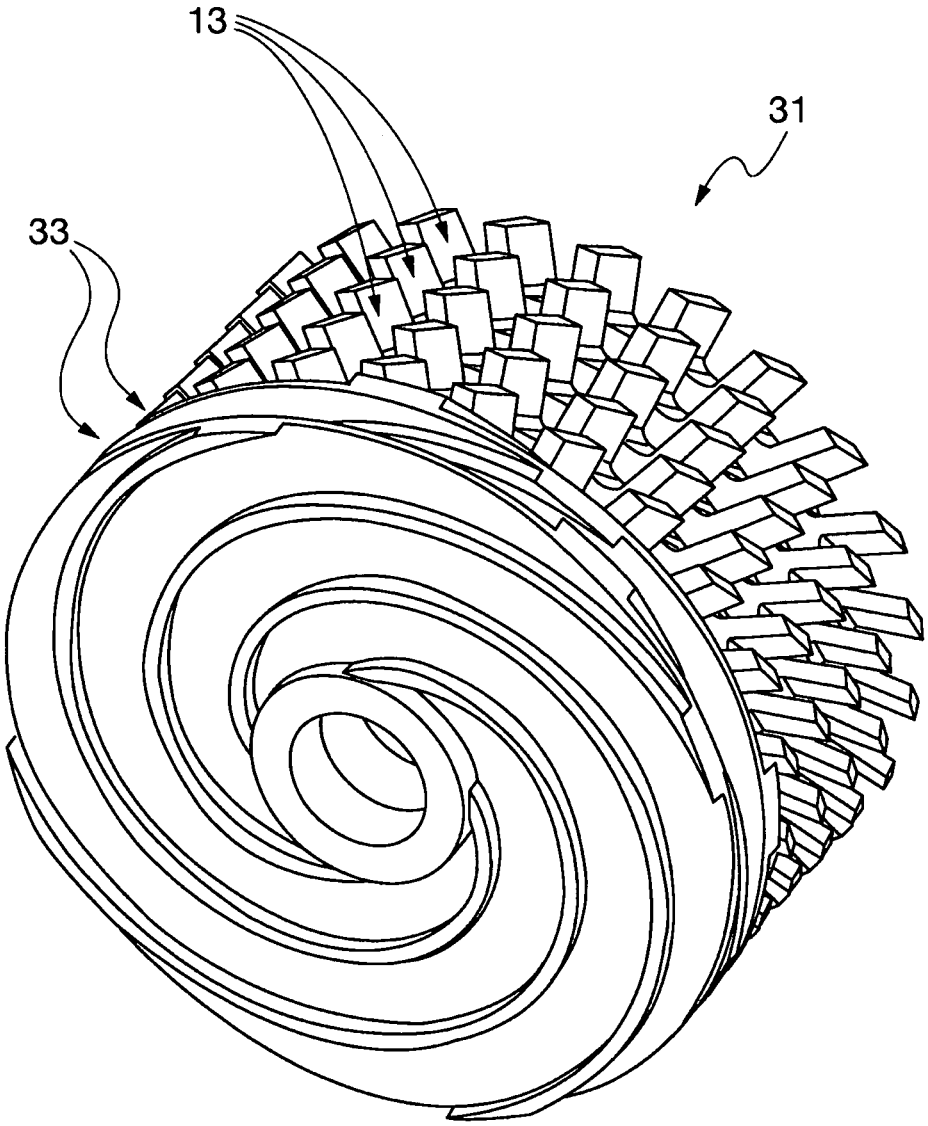
FIG. 7 is a schematic cross-sectional view of the pump rotor shown in FIG. 6.

Turning now to FIGS. 6 and 7, there is shown the rotor 31 of a vacuum pump according to a second embodiment, the rotor comprising a first plurality of rotor elements 13, intended to cooperate with respective stator elements for obtaining corresponding turbomolecular pumping stages, and a second plurality of molecular drag rotor elements ("rotor elements") 33, intended to cooperate with respective stator elements for obtaining corresponding molecular drag pumping stages, arranged downstream from the turbomolecular pumping stages.

In the rotor 31, all rotor elements 13 are of the kind shown in FIGS. 2 and 3, made of plastic material reinforced with short fibres. All rotor elements 33 are of the kind shown in FIG. 5, made of plastic material reinforced with short fibres.

The rotor elements 13 and rotor elements 33 are fitted onto the rotating shaft (not shown) of a vacuum pump, which passes through the central through-holes formed in the rotor elements and rotor elements and are stacked on one another to form the vacuum pump rotor 31.

As shown in FIG. 6, rotor elements 33 advantageously comprise a plurality of spiral channels 35*a*,35*b*,35*c* on a first surface and a plurality of further spiral channels 35'*a*,35'*b*, 35'*c* on the opposite surface, where each of the rotor surfaces being suitable for cooperating with the smooth surface of a respective stator element.

In an alternative embodiment with respect to what is shown in FIGS. 6 and 7, the rotor of a vacuum pump comprising a plurality of turbomolecular rotor elements ("rotor elements") 13 and a plurality of rotor elements 33 can be manufactured as a single, monolithic piece, for instance by injection moulding, thus permitting to manufacture a rotor in a very inexpensive process.

It is also clear that the preceding detailed description is in no way limiting and that several changes and modifications are possible without departing from the scope of the present teachings, as defined in the appended claims.

In particular, even if in the illustrated embodiments reference has been made to one or more turbomolecular rotor elements and/or molecular drag rotor elements made of plastic material reinforced with short fibres, it is possible to envisage that the vacuum pump comprises in alternative, or in addition to, the turbomolecular rotor elements and/or molecular drag rotor elements one or more turbomolecular stator elements and/or molecular drag stator elements made of plastic material reinforced with short fibres, or even of non-reinforced plastic material given the lower stress the stator is subjected to.

We claim:

1. A vacuum pump, comprising:

a vacuum-tight casing;

a suction port;

a discharge port; and a pumping stage configured for pumping a gas from the suction port to the discharge port and comprising a plurality of pumping elements that cooperate with each other for pumping the gas through the pumping stage, the pumping elements comprising:

a stator element, stationary and fastened to the casing; and a rotor element mounted integral with a rotating shaft, and the rotating shaft configured to rotate about an axis thereof, wherein the pumping stage is selected from the group consisting of a turbomolecular pumping stage and a molecular drag pumping stage, the rotor element is made of an injection moulded plastic material charged with reinforcing short fibres, and the reinforcing short fibres are dispersed in a chaotic and random manner inside the plastic material.

2. The vacuum pump according to claim 1, wherein the plastic material is a thermoplastic resin or a thermosetting resin.

3. The vacuum pump according to claim 1, wherein the plastic material is a semi-crystalline polymer.

4. The vacuum pump according to claim 1, wherein the reinforcing short fibres are carbon or graphite short fibres, glass short fibres, or aramidic short fibres.

5. The vacuum pump according to claim 1, wherein the plastic material is charged with 10% to 50% in weight of the short fibres, or with 30% to 40% in weight of the short fibres.

6. The vacuum pump according to claim 1, wherein the stator element is made of the plastic material charged with the reinforcing short fibres.

7. The vacuum pump according to claim 1, wherein the pumping stage is a turbomolecular pumping stage and the rotor element is a turbomolecular rotor element.

8. The vacuum pump according to claim 7, wherein the turbomolecular rotor element is substantially disc-shaped and comprises a center and a periphery, and is tapered from the center to the periphery.

9. The vacuum pump according to claim 1, wherein the pumping stage is a molecular drag pumping stage and the rotor element is a molecular drag rotor element.

10. The vacuum pump according to claim 9, wherein the molecular drag rotor element comprises a rotor body having at least one spiral channel on at least one surface thereof.

11. The vacuum pump according to claim 10, wherein a cross-sectional area of the at least one spiral channel is reduced from a center of the molecular drag rotor element to an outer periphery of the molecular drag rotor element.

12. The vacuum pump according to claim 1, wherein all rotor elements of the vacuum pump are made in the plastic material, the rotor elements being fitted on the rotating shaft and stacked on each other.

13. The vacuum pump according to claim 1, wherein all rotor elements of the vacuum pump are made in the plastic material, the rotor elements together being made as a single, monolithic piece.

* * * * *